US012740677B2

(12) United States Patent
Hale et al.

(10) Patent No.: US 12,740,677 B2
(45) Date of Patent: Sep. 22, 2026

(54) CLEANER HEAD FOR A CLEANING APPLIANCE

(71) Applicant: Techtronic Cordless GP, Anderson, SC (US)

(72) Inventors: Tobias Hale, Gretton (GB); Peter Davies, London (GB); Samuel Bennett, Downend Bristol (GB)

(73) Assignee: Techtronic Floor Care Technology Limited, Tortola (VG)

( * ) Notice: Subject to any disclaimer, the term of this patent is extended or adjusted under 35 U.S.C. 154(b) by 696 days.

(21) Appl. No.: 17/787,480

(22) PCT Filed: Dec. 18, 2020

(86) PCT No.: PCT/GB2020/053309
§ 371 (c)(1),
(2) Date: Jun. 20, 2022

(87) PCT Pub. No.: WO2021/123827
PCT Pub. Date: Jun. 24, 2021

(65) Prior Publication Data

US 2023/0033367 A1 Feb. 2, 2023

(30) Foreign Application Priority Data

Dec. 20, 2019 (GB) ..... 1918984

(51) Int. Cl.
*A47L 7/00* (2006.01)
*A47L 9/04* (2006.01)

(52) U.S. Cl.
CPC ..... *A47L 7/0009* (2013.01); *A47L 7/0019* (2013.01); *A47L 9/0477* (2013.01)

(58) Field of Classification Search
CPC .... A47L 7/0009; A47L 7/0019; A47L 9/0477; A47L 11/145; A47L 11/4088; A47L 11/185; A47L 11/34
See application file for complete search history.

(56) References Cited

U.S. PATENT DOCUMENTS 3,321,331 A 5/1967 McNeely
3,883,301 A * 5/1975 Emrick ..... A47L 11/4088 15/322

(Continued)

FOREIGN PATENT DOCUMENTS

EP 0836828 A2 4/1998
EP 2967270 1/2016

OTHER PUBLICATIONS

International Search Report and Written Opinion for Application No. PCT/GB2020/053309 dated Feb. 26, 2021 (9 pages).

(Continued)

*Primary Examiner* — Patrick D Maines
(74) *Attorney, Agent, or Firm* — Michael Best & Friedrich LLP

(57) ABSTRACT

A cleaner head for a cleaning appliance including an agitator rotatable about an axis; a housing having a front side, a rear side, and first and second sides which extend between the front and rear sides, said housing defining a chamber which at least partially surrounds the agitator, the chamber having a dirty air inlet and a dirty air outlet; and a spray nozzle device for spraying cleaning fluid onto the agitator in a direction towards the rear side of the housing, said spray nozzle device being fluidly connectable to a cleaning fluid supply tank of a cleaning apparatus.

26 Claims, 9 Drawing Sheets

(56) References Cited

U.S. PATENT DOCUMENTS

| | | | | |
|---|---|---|---|---|
| 4,182,001 | A | 1/1980 | Krause | |
| 4,360,946 | A | 11/1982 | Marshall, Jr. et al. | |
| 4,488,329 | A | 12/1984 | Lackenbach | |
| 5,542,147 | A | 8/1996 | Merten | |
| 2009/0229069 | A1* | 9/2009 | Lenkiewicz | A47L 11/4088 15/320 |
| 2014/0259514 | A1* | 9/2014 | Vail | A47L 11/408 15/322 |
| 2021/0093143 | A1* | 4/2021 | Nguyen | A47L 9/2857 |

OTHER PUBLICATIONS

Search Report issued by the United Kingdom Intellectual Property Office for Application No. 1918984.4 dated Jun. 22, 2020 (2 pages).

* cited by examiner

CLEANER HEAD FOR A CLEANING APPLIANCE

CROSS-REFERENCE TO RELATED APPLICATIONS

This application is a U.S. national phase application of International Patent Application No. PCT/GB2020/053309, filed Dec. 18, 2020, which claims priority to UK Patent Application No. 1918984.4, filed Dec. 20, 2019, the entire contents all of which are hereby incorporated by reference herein.

FIELD OF THE INVENTION

The present invention relates to a cleaner head for a cleaning appliance. In particular, but not exclusively, the invention relates to a cleaner head for a multi-floor, or wet/dry, vacuum cleaner.

SUMMARY

According to a first aspect of the invention we provide a cleaner head for a cleaning appliance including:

an agitator rotatable about an axis;

a housing having a front side, a rear side, and first and second sides which extend between the front and rear sides, said housing defining a chamber which at least partially surrounds the agitator, the chamber having a dirty air inlet and a dirty air outlet; and a spray nozzle device for spraying cleaning fluid onto the agitator in a direction towards the rear side of the housing, said spray nozzle device being fluidly connectable to a cleaning fluid supply tank of a cleaning apparatus.

At least a portion of the spray nozzle device may be positioned above an upwardly facing surface of the agitator.

At least a portion of the spray nozzle device may be positioned above an uppermost portion of the agitator.

At least a portion of the spray nozzle device may be positioned above a plane which is tangent to an upwardly facing surface of the agitator and which is generally parallel to a surface to be cleaned.

A spray head of the spray nozzle device may project into the chamber.

The spray head may be positioned at or near a portion of the chamber which is close to or at the front side of the housing.

The direction in which fluid exits the spray head may be in a direction generally orthogonal to the axis of the agitator.

Said portion of the spray nozzle device may include the spray head.

The spray nozzle device may include a first portion having a fluid pathway extending along an axis A from which cleaning fluid is ejected. The fluid pathway may extend towards the front side of the housing. The spray nozzle device may include a deflector for deflecting cleaning fluid ejected from the fluid pathway towards the agitator.

The deflector may deflect cleaning liquid in a direction substantially orthogonal to the axis A.

The deflector may deflect cleaning fluid towards, preferably so as to intersect, the axis of the agitator.

The axis A may extend over an upwardly facing surface of the agitator.

Said portion of the spray nozzle device may include the fluid pathway and/or the deflector.

The spray nozzle may spray cleaning fluid towards, e.g. downwardly towards, an upwardly facing surface of the agitator.

The chamber may include an opening for permitting access to and removal of the agitator from the chamber, a cover cooperatively associated with the housing for permitting access to the chamber through the opening, and wherein the cover may be moveable to an agitator access position to permit the agitator to be removed from the chamber through the opening.

The cover may pivotably movable with respect to the housing to an agitator access position.

The opening and the cover may be positioned at or on the front side of the housing.

The spray nozzle device may be positioned on the housing and preferably spaced from the cover.

The cleaner head may include at least first and second spray nozzle devices, preferably positioned spaced from each other along a length of the agitator.

The second spray nozzle device may include one or more or all of the features of the spray nozzle device as set forth in the previous statements of invention.

The second spray nozzle device may be substantially the same as the first spray nozzle device. The first spray nozzle device may be positioned closer to the first side of the housing. The second spray nozzle device may be positioned closer to the second side of the housing.

According to a second aspect of the invention we provide a cleaning appliance including:

a main body;

a cleaning fluid supply tank for holding a cleaning fluid which is preferably releasably connectable to the main body; and a cleaner head according to the first aspect of the invention;

wherein the cleaning fluid supply tank is fluidly connected to the spray nozzle device.

The cleaning appliance may include a source of suction and a dirt collection container.

BRIEF DESCRIPTION OF THE DRAWINGS

Embodiments of the invention will now be described, by way of example only, with reference to the accompanying drawings, of which.

DETAILED DESCRIPTION

Figure 1:
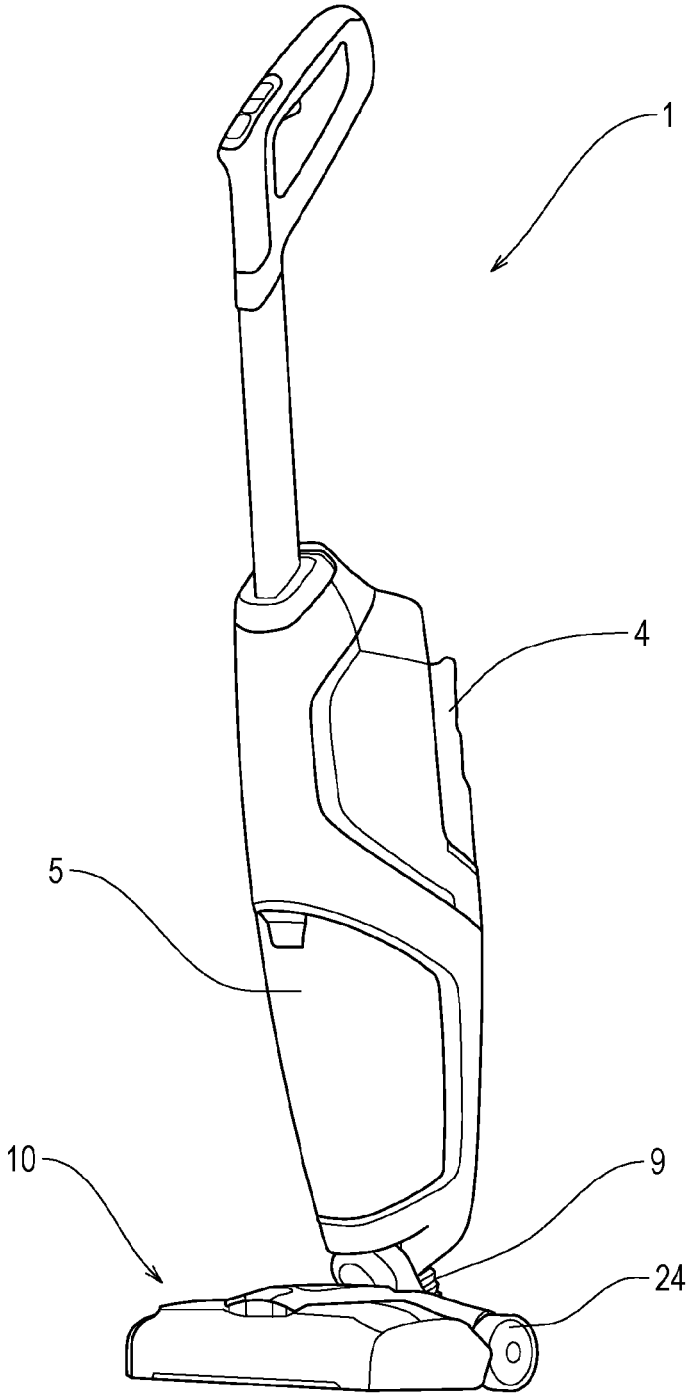
FIG. 1 is a perspective view of a vacuum cleaner in accordance with an embodiment of the invention.
Figure 2:
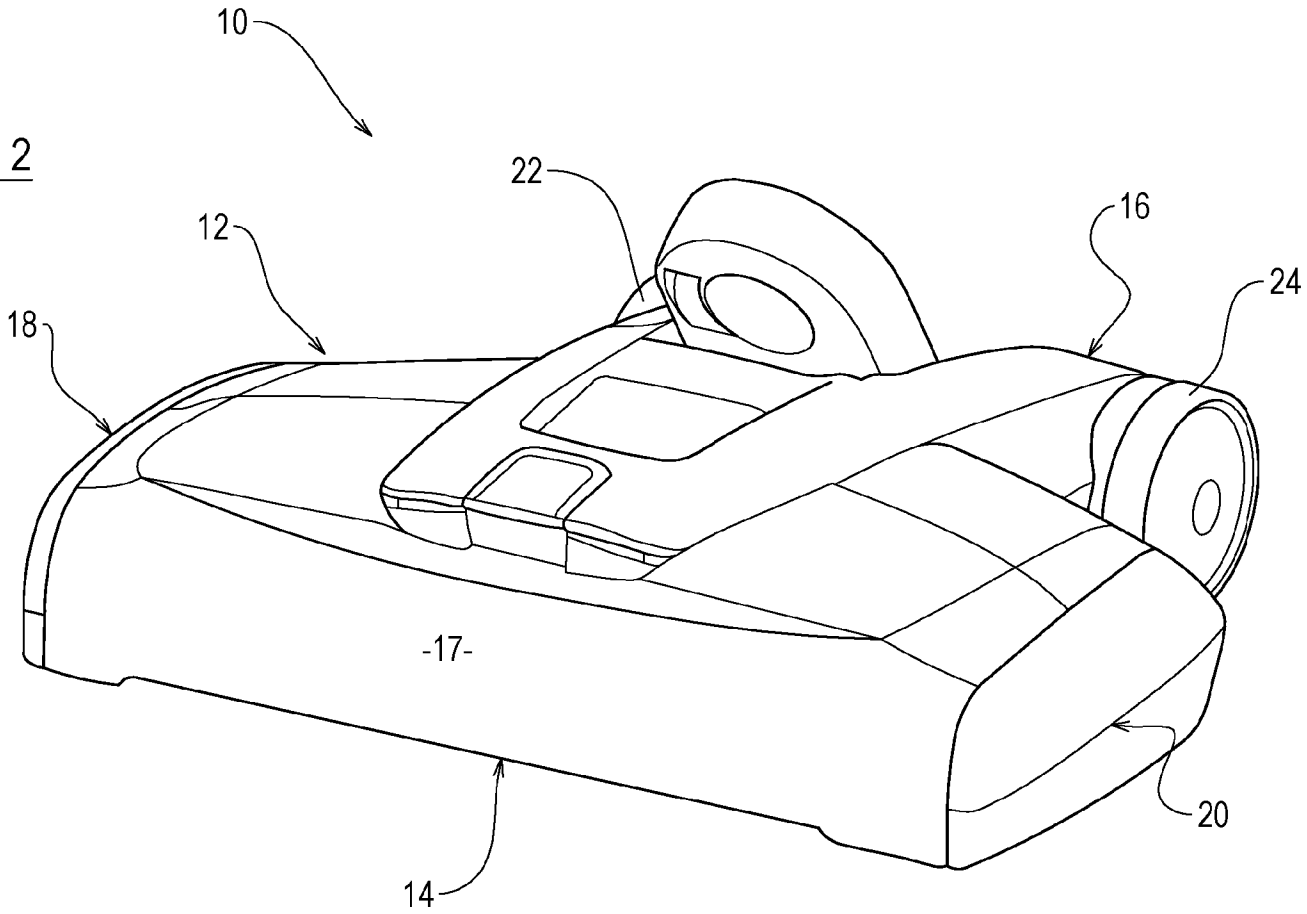
FIG. 2 is a perspective view of a cleaner head in accordance with an embodiment of the invention (outlet pipe 9 not shown)

Referring to FIG. 1 there is shown a surface cleaning appliance 1 according to an embodiment of the invention.

The surface cleaning appliance 1 is, in particular a wet/dry vacuum cleaner, or multi-floor, cleaner. The surface cleaning appliance 1 includes a main body 2 and a cleaner head 10. The surface cleaning appliance 1 may rest on the cleaner head 10 in use and/or when in a stored position. The main body 2 may be connected to the cleaner 10. In particular the main body 2 may be pivotably connected to the cleaner head 10. The connection between the main body 2 and the cleaner head 10 may permit the main body to pivot in a fore-aft direction in which the cleaner is moved during use and to respective left and right sides of the cleaner head 10 which are generally perpendicular, or perpendicular, to the fore-aft direction in which the cleaner is moved during use. In particular the pivotal connection may permit the main body 2 to sit within a periphery of the cleaner head 10, i.e. within front, rear and first and second sides of the cleaner head 10 (described in more detail below), so that a centre of gravity of the surface cleaning appliance 1 is positioned within a footprint of the cleaner head 10. This permits the surface cleaning appliance to be stored in an upright position. To permit this pivotal connection an outlet pipe 9 is provided between the cleaner head 10 and the main body 2. The outlet pipe 9 is relatively flexible and ensures that the pivotal connection between the main body 2 and cleaner 10 can function. The outlet pipe 9 is fluidly connected to a dirty air outlet of the cleaner head and to a dirt collection container 5. This is described in more detail below.

It should be appreciated that in other embodiments the main body 2 may be fixed in position with respect to the cleaner head 10. In further envisaged embodiments the surface cleaning appliance 1 may be a cylinder style cleaner. In such embodiments the surface cleaning appliance may include a wand, a first end of which is connected to the outlet pipe 9 and a second end of which is connected to the cleaner head 10.

The surface cleaning appliance includes a handle 3 for a user to grasp. The handle 3 may be positioned above the main body 2. In particular the handle 3 may be positioned at a top of the surface cleaning appliance 1.

The main body 2 houses a source of suction, e.g. a motor, fan, impeller, for creating a vacuum (not shown). In some embodiments the motor may be a brushless motor. The source of suction may be positioned at a top of the main body 2. In particular, the source of suction may be positioned adjacent the handle 3.

A cleaning fluid supply tank 4 for holding a cleaning fluid is supported on the main body 2. In use, the cleaning fluid supply tank 4 receives fluid for cleaning a surface to be cleaned. For example, the cleaning fluid supply tank may receive a pre-mixed cleaning solution for cleaning a surface. In other embodiments the cleaning fluid supply tank 4 may receive water to which a concentrated cleaning solution is added, either in the cleaning fluid supply tank or subsequently from a further cleaning fluid supply tank (not shown) of the cleaning appliance 1. The cleaning fluid supply tank 4 is releasably connectable to the main body 2, although it could be fixed in the main body 2. In particular, the cleaning fluid supply tank 4 is received, at least partially, within a recess on an exterior surface of the main body 2. A fluid inlet (not shown) is provided in the recess to which the cleaning fluid supply tank 4 is fluidly connectable. The cleaning fluid supply tank 4 is positioned on the rear of the main body 2 with respect to a fore-aft direction in which the cleaner is moved during use. The cleaning fluid supply tank 4 is also positioned close to, or adjacent, the source of suction.

The fluid inlet is fluidly connected to a cleaning fluid dispensing device 40 on the cleaner head 10. In this particular embodiment the cleaning fluid dispensing device is at least one spray nozzle device 40. The at least one spray nozzle device 40 sprays cleaning fluid onto an agitator of the cleaner head 10. The at least one spray nozzle device 40 may additionally spray cleaning fluid onto a surface to be cleaned. The cleaning fluid dispensing device is fluidly connected to the fluid inlet via fluid channels which extend from and through the main body 2 to the cleaner head 10. This permits fluid from the cleaning fluid supply tank 4 to be conveyed to the cleaning fluid dispensing device 40.

The main body 2 also supports a dirt collection container 5 which is fluidly connected to the source of suction. The dirt collection container 5 is also fluidly connected to the dirty air outlet of the cleaner head by the outlet pipe 9. The dirt collection container may include an air/liquid separator to separate any dirty cleaning fluid, and dirt entrained therein, which has been suctioned from the surface to be cleaned from the air. The dirt collection container 5 is releasably connectable to the main body 2 of the cleaning appliance 1, although it could be fixed in the body 2. The dirt collection container is also provided in a lower half of the main body 2, closer to the cleaner head 10 than the handle 3. The dirt collection container 5 is provided on a front of the main body with respect to a fore-aft direction in which the cleaner is moved during use. The dirt collection container 5 may support a bag or other receptacle for holding collected dirt, with the bag or other receptacle being removable for discarding the collected dirt.

The cleaner head 10 is described in more detail below with reference to FIGS. 2 to 9.

Figure 3:
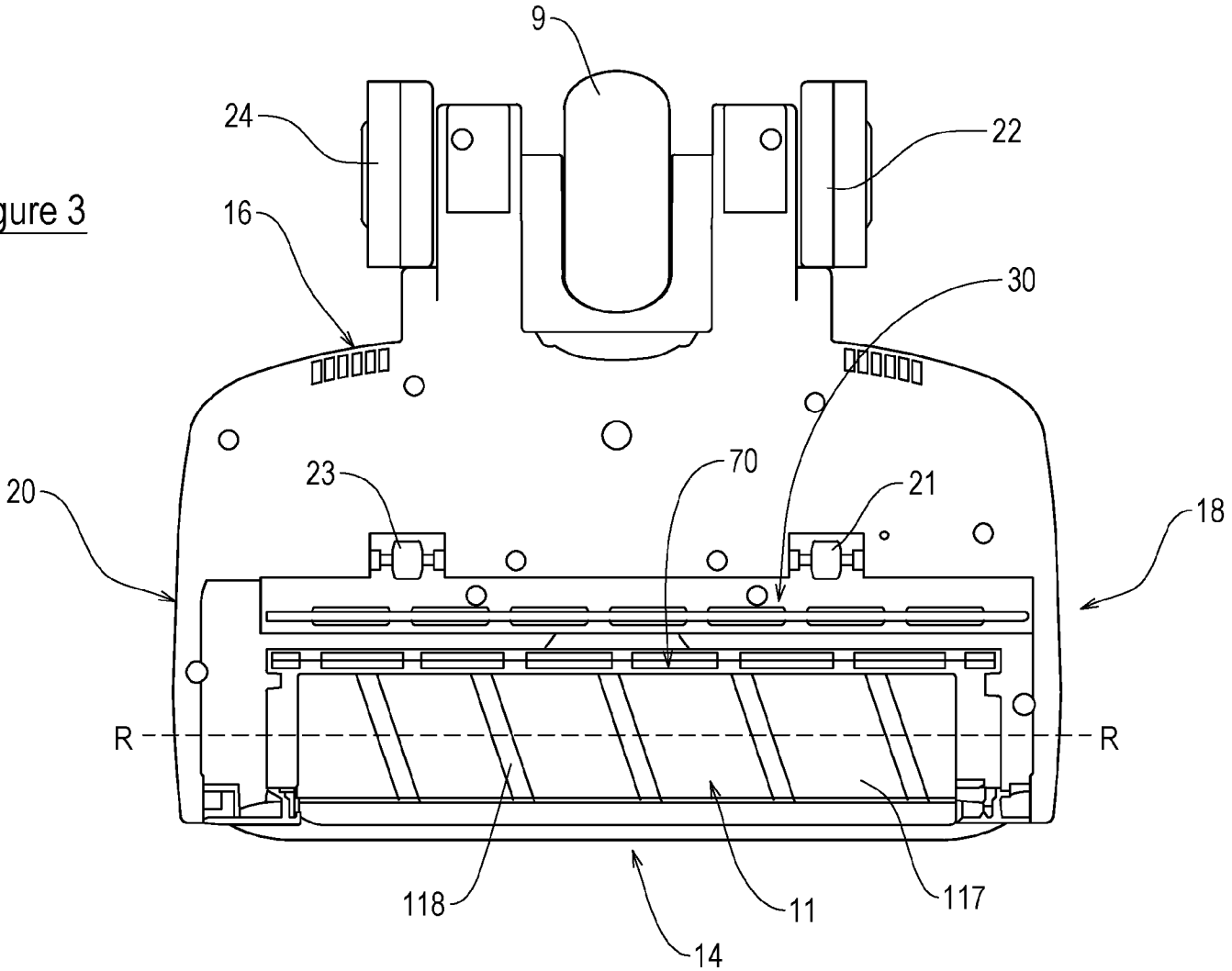
FIG. 3 is a bottom view of the cleaner head of FIG. 2.

In the present embodiment the cleaner head 10 includes wheels 22, 24 which are positioned at a rear side 16 of the cleaner head 10. In particular, the wheels 22, 24 are positioned either side of the outlet pipe 9 which fluidly connects a dirty air outlet 26 of the cleaner head 10 to the dirt collection container 5. As can be seen in FIG. 3, further wheels 21, 23 are provided on a floor facing surface of the cleaner head 10. The wheels 22, 24 and further wheels 21, 23 permit the surface cleaning appliance 1 to move across a surface to be cleaned. In other embodiments the cleaner head 10 may be provided with a roller instead of, or in addition to, the wheels 22, 24 positioned at the rear side 16 of the cleaner head 10.

The cleaner head 10 includes a housing 12 which is movable along a surface to be cleaned. The housing 12 also includes a front side 14 and first and second sides, e.g. left and right sides, 18, 20 which extend between the front side 14 and the rear side 16. The front side 14, rear side 16, and first and second sides 18, 20 define a periphery which defines a footprint of the cleaner head 10. The housing 12 includes a floor facing surface 28 which is described in more detail below.

The housing 12 includes a top surface 25. The top surface 25 extends between the front side 14, rear side 16 and first and second sides 18, 20. In use, the top surface 25 faces away from a surface to be cleaned.

The cleaner head 10 also includes an agitator 11 rotatable about an axis R within a chamber 13 at least partially defined by the housing 12. The axis R lies in a generally vertical plane V. The axis R is generally parallel to a surface to be cleaned and orthogonal to a fore-aft direction in which the cleaner is moved during use. The agitator 11 is formed as a generally cylindrical member with a microfibre material 117 on its outer surface 113. The microfibre material 117 may be tufted. Bristles 118 may be interspersed with the microfiber material. The bristles 118 may be provided in tufts in a helical pattern on the outer surface of the agitator 11.

The floor facing surface 28 extends between the front side 14, rear side 16 and first and second sides 18, 20. In use the floor facing surface 28 faces a surface to be cleaned. The floor facing surface 28 includes a floor engaging device 30 and a wiper device 70. The floor engaging device 30 is positioned rearwardly of the wiper device 70. The floor facing surface 28 includes a dirty air inlet 27 through which dirt entrained air and dirty cleaning fluid may be received by the cleaner head 10. The dirty air inlet 27 extends between a portion of the agitator which contacts the surface to be cleaned in use and the wiper device 70.

The chamber 13 at least partially surrounds the agitator 11. The chamber 13 is at least partially defined by a rear chamber wall 200. The rear chamber wall 200 defines the dirty air outlet 26. The dirty air outlet 26 is fluidly connected to the chamber 13. The chamber 13 is also fluidly connected to the dirty air inlet 27 which faces the surface to be cleaned.

The chamber 13 includes an opening 15 for permitting access to and removal of the agitator 11 from the chamber 13. The opening 15 extends at least partially across a front side 14 of the housing 12 between the first and second sides 18, 20 and the top and floor facing surfaces 25, 28. The agitator 11 may be interchangeable with other types of agitator.

Figure 4:
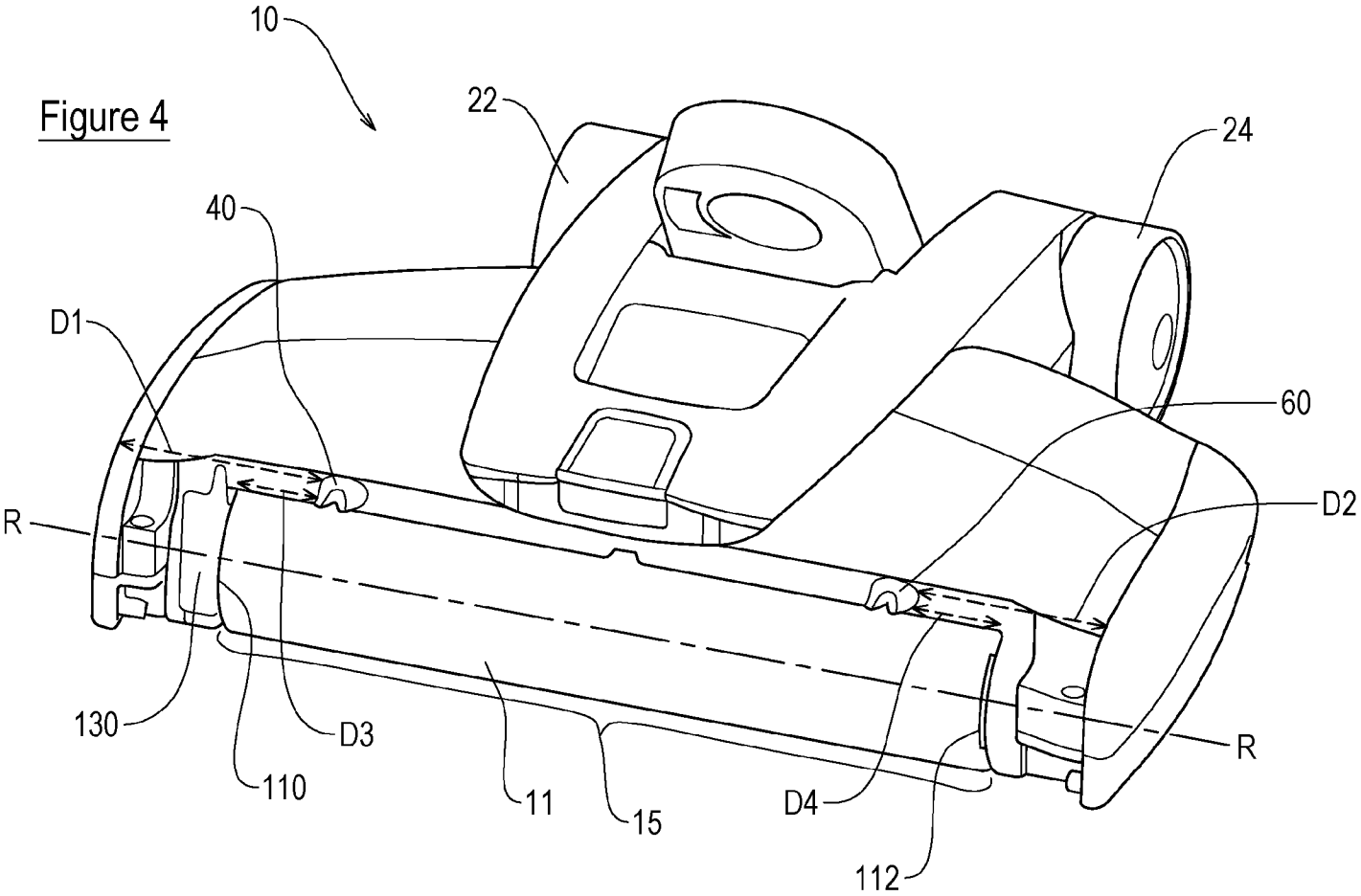
FIG. 4 is a further perspective view of the cleaner head of FIG. 2 with a cover of the cleaner head removed (outlet pipe 9 not shown)
Figure 5:
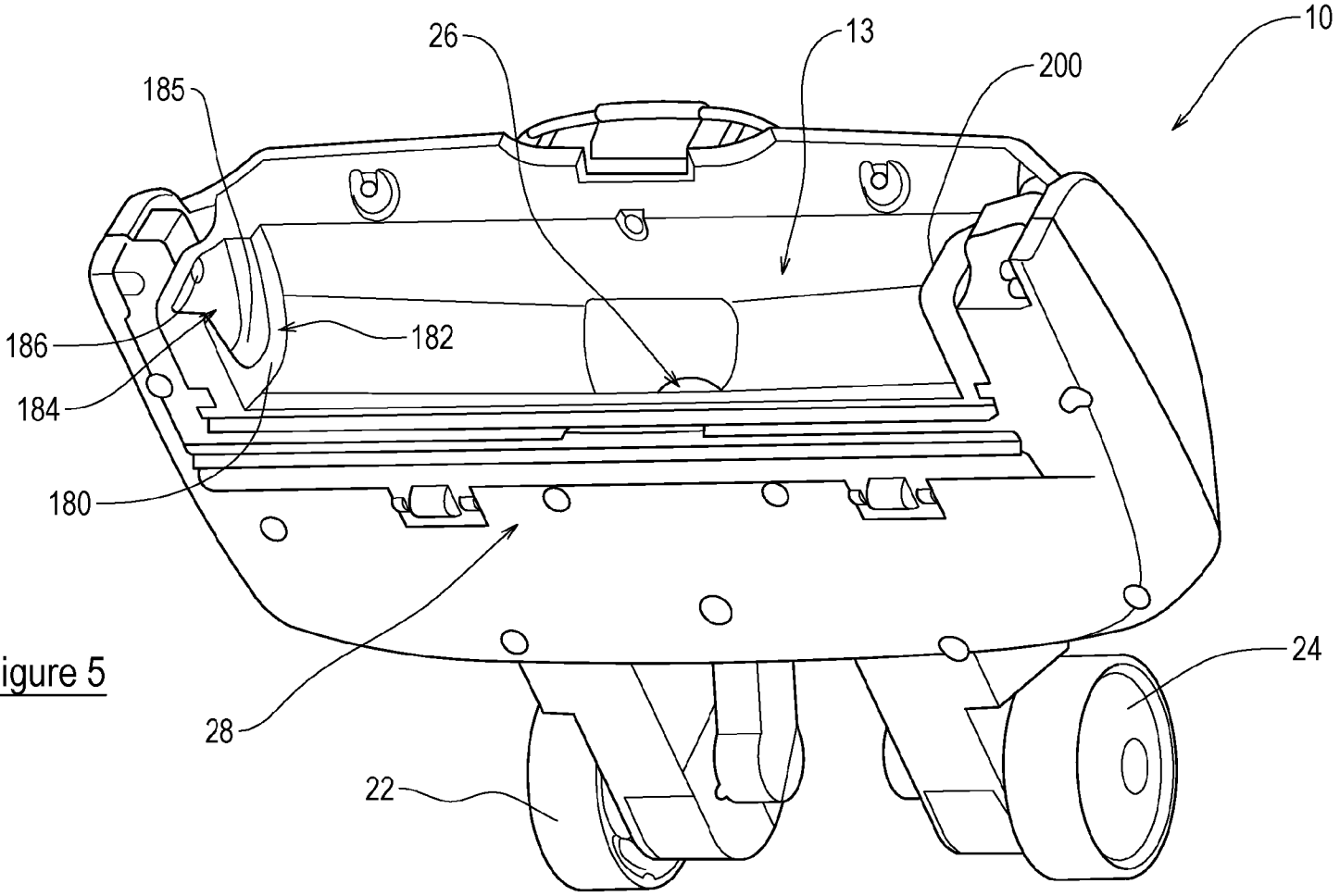
FIG. 5 is a bottom perspective view of the cleaner head of FIG. 2 with a cover and agitator of the cleaner head removed (outlet pipe 9 not shown)
Figure 6:
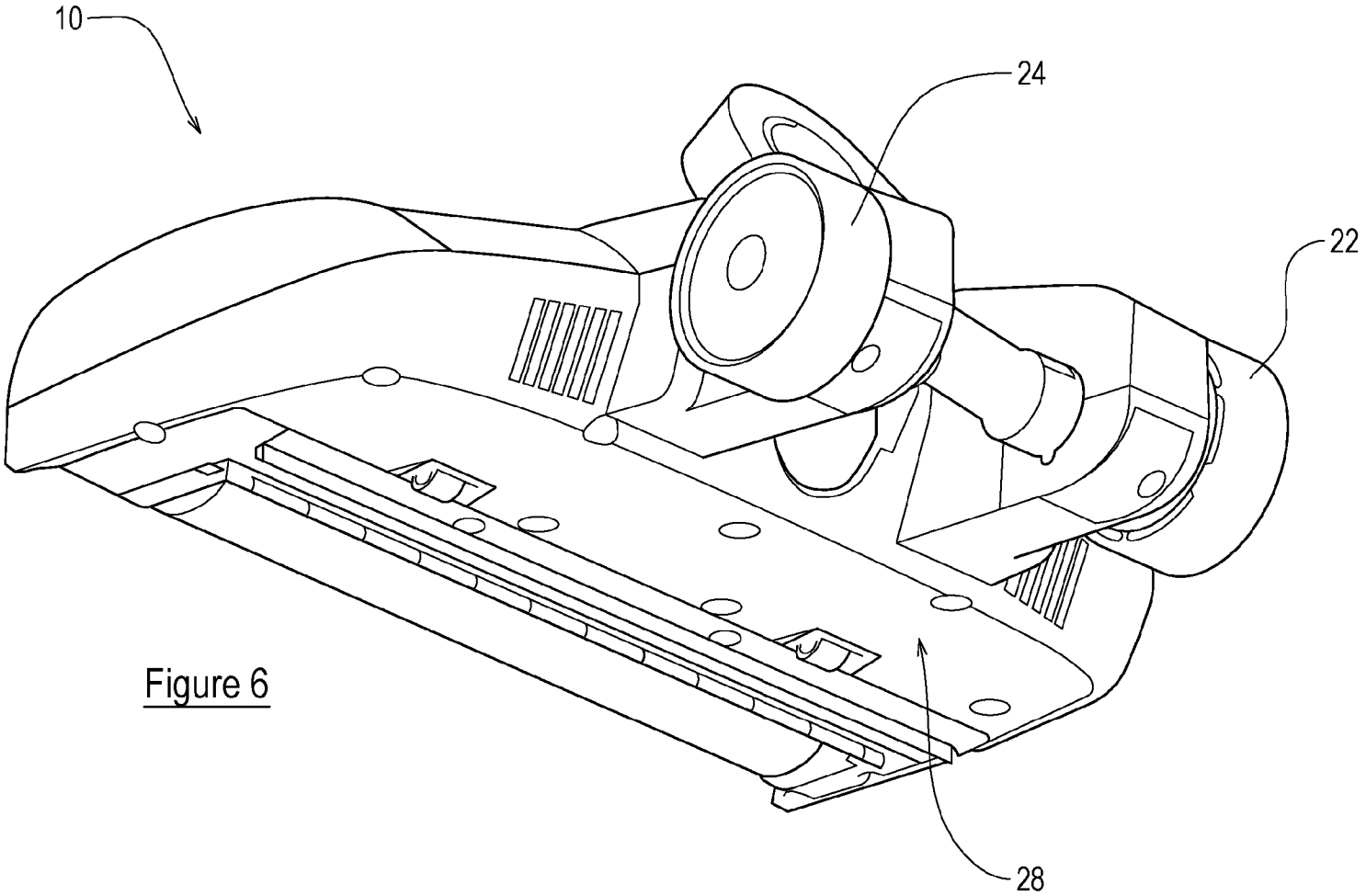
FIG. 6 is a further bottom perspective view of the cleaner head of FIG. 2 (outlet pipe 9 not shown)

The cleaner head 10 includes a cover 17 positioned, in use, over the opening 15 on the front side 14 of the housing 12. The cover 17 also extends across the front side 14 of the housing 12 and between the first and second sides 18, 20 and the top and floor facing surfaces 25, 28. The cover 17 is cooperatively associated with the housing 12 for permitting access to the chamber 13 through the opening 15 in the front side 14 of the housing 12. In FIGS. 1 to 3 and 7 to 9 the cover 17 is shown closing the opening 15. In FIGS. 4 to 6 the cover 17 has been moved to, and is shown in, an agitator access position. The cover 17 is typically in an, in use, position in which the cover 17 covers the opening 15. The cover 17 is movable to an agitator access position, as shown in FIGS. 4 to 6, to permit the agitator 11 to be removed from the chamber 13 through the opening 15 in a direction substantially orthogonal to the axis R of the agitator 11 and in a direction which is substantially parallel to a plane of the surface to be cleaned. In particular, a first end 110 of the agitator is pivoted about a second end 112 of the agitator to remove the first end 110 through the opening 15 before the remainder of the agitator 11 is removed through the opening 15.

A first end 110 of the agitator 11 is provided with a tab 130 including a grip for a user to grip to facilitate removal of the agitator from the chamber 13 through the opening 15 in the front 14 of the housing 12. The tab 130 may abut an interior surface of the cover 17 when the cover 17 is in the in use position. In other embodiments a gap may be provided between the interior surface of the cover 17 and the tab 130 when the cover 17 is in an in use position. In the present embodiment the tab 130 includes a formation (not shown). The formation is positioned on a surface of the tab 130 which faces the inwardly facing surface 182 of the first side wall 180 which at least partially defines the chamber 13. When the agitator 11 is inserted into the chamber 13 the tab 130 abuts the abutment wall 185 and is received in the recess 184. The formation of the tab 130 then engages the further recess 186 when the agitator 11 in position in the chamber 13 to provide a snap-fit connection between the housing 12 and the agitator 11. The tab 130 further includes a bearing which permits the tab 130 to be held in housing 12 whilst permitting the agitator 11 to rotate relative to the tab 130.

The cover 17 may be provided with a wiper device 80 which engages the agitator 11. The wiper device 80 may have slits therein to permit an airflow over a top of the agitator 11. The wiper device 80 advantageously removes excess moisture from the agitator 11.

As mentioned above, the cleaner head 10 includes a spray nozzle device 40 for spraying cleaning fluid. In the present embodiment the cleaner head 10 includes first and second spray nozzle devices 40, 60 for spraying cleaning fluid. In embodiments only a single spray nozzle device 40 may be provided. In further embodiments at least three spray nozzle devices may be provided along the length of the agitator 11. The first and second spray nozzle devices 40, 60 are substantially the same and so only the first spray nozzle device 40 will be described in detail. However, it should be appreciated that in other embodiments the first and second spray nozzle devices may differ. For example, the first spray nozzle device may deliver a first cleaning solution and the second spray nozzle device may deliver a second cleaning solution.

As described above, and shown in FIG. 4, the cleaner head 10 may be provided with first and second spray nozzle devices 40, 60. The spray nozzle devices 40, 60 are preferably positioned on the housing rearwardly of a surface of the cover 17 which faces into the chamber 13, and are preferably spaced from said surface of the cover 17. In other words, the spray nozzles devices 40, 60 are positioned on the housing and not on the cover 17 itself. The spray nozzle devices 40, 60 are preferably positioned spaced from each other along a length of the agitator 11. In embodiments the spray nozzle devices 40, 60 are spaced from each along an axis which is parallel to the axis R of the agitator 11. In other embodiments the first spray nozzle device 40 may be positioned above the second spray nozzle device 60, or the first spray nozzle device 40 may be positioned directly adjacent the second spray nozzle device 60. The first spray nozzle device 40 may be positioned closer to the first side 18 of the housing 12. The second spray nozzle 60 may be positioned closer to the second side 20 of the housing 12. In particular, the first and/or second spray nozzle devices 40, 60 may be positioned respective distances D1, D2 inwardly of the respective first and second sides 18, 20 of the housing 12. The distance D1, D2 may be between 53.50 mm and 83.50 mm, or 58.50 mm and 78.50 mm, or 63.50 mm and 73.50 mm, or approximately 68.50 mm.

The spray nozzle device 40 sprays cleaning fluid onto the agitator 11. The direction of spraying is towards the rear side 16 of the housing 12. In embodiments the direction of spraying may be from the front side 14 to the rear side 16 of the housing 12 in a generally fore-aft direction in which the cleaner head 10 is moved during use. In embodiments the direction of spraying may differ. For example, the direction of spraying may be inwardly from respective first and second sides 18, 20 of the housing 12. The direction of spraying may alternatively, or additionally, be diagonal to the axis R so as to intersect a generally vertical plane V in which the axis R of the agitator 11 lies.

Figure 7:
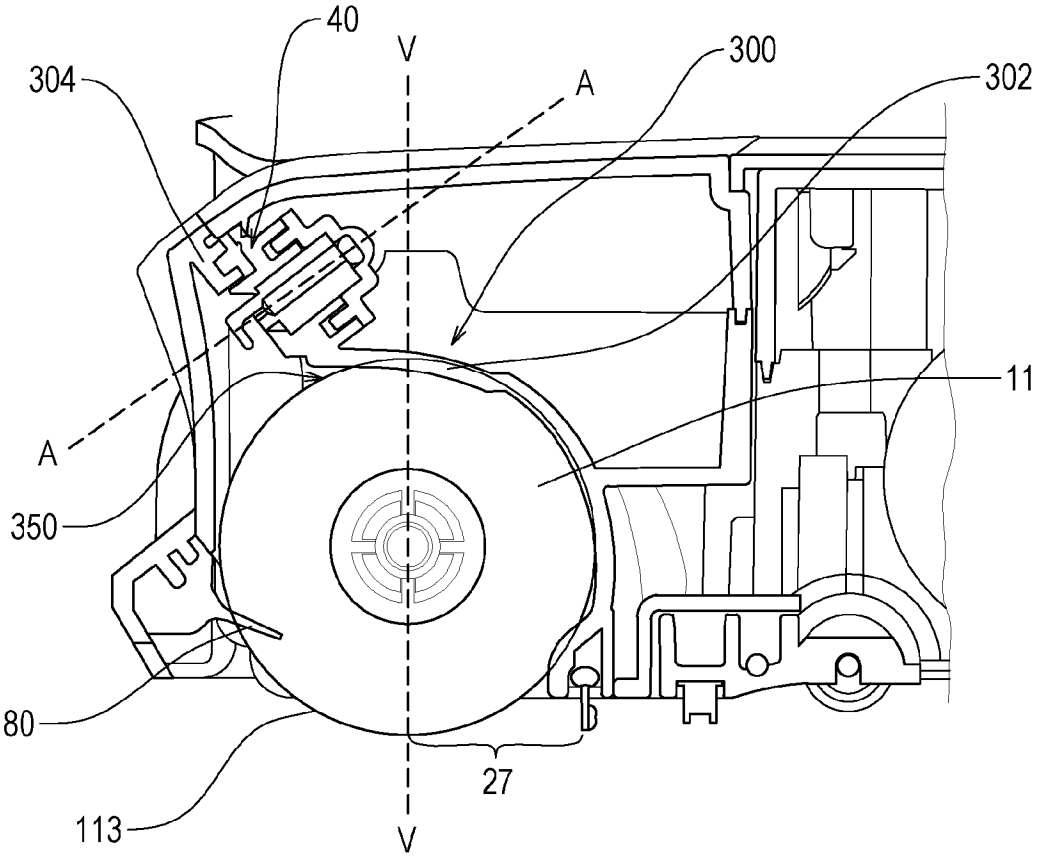
FIG. 7 a cross-sectional view of a front portion of the cleaner head 10 along an axis R of the agitator.

The spray nozzle device 40 includes a spray head 42. The spray head 42 projects into the chamber 13. In embodiments the spray nozzle device 40 may include two or more spray heads 42 positioned adjacent each other and/or spaced from each other along a length of the agitator 11. In embodiments, and as shown at FIG. 7, the spray head 42 projects, at least partially, into the chamber through an upper wall 300 which forms the chamber 13. In embodiments, the upper wall 300 may be formed, generally, from at least two portions. The first portion 302 may be curved and have an inwardly facing surface which faces towards an upwardly facing surface 350 of the agitator 11. The first portion 302 may be substantially horizontal, or horizontal. The second portion 304 may lie in a plane which intersects the first portion 302 and may face towards the front side 14 of the housing 12. The spray head 42 may project into the chamber 13 through the second portion 304. The spray head 42 is positioned at or near a portion of the chamber 13 which is close to the front side 14 of the housing 12. In other words, at least a portion of the spray head 42 is positioned in a portion of the chamber 13 which is located rearwardly of a surface of the cover 17 which surface faces into the chamber 13. In embodiments the spray head 42 may be adjacent the front 14 of the housing 12. The spray head 42 is oriented in a direction which is generally orthogonal to the axis R of the agitator 11. In other words, the spray head 42 is oriented for spraying cleaning fluid in a direction from the rear side 16 of the housing 12 towards the front side 14 of the housing 12. In other envisaged embodiments the spray head may be provided on the cover 17 and project into the chamber 13. Fluid conduits may be provided in the cover 17 to convey cleaning fluid from a cleaning fluid supply tank to the spray nozzle device 40 and therefore the spray head 42. In embodiments a portion of the spray nozzle device 40 may be provided on a remainder of the housing 12.

The spray nozzle device 40 includes a first portion 44 which includes a fluid pathway 46 for conveying cleaning fluid to the spray head 42. The fluid pathway 46 defines an axis A. The axis A extends towards the front side 14 of the housing 12. The first portion 44 may have an axis which is substantially parallel, or coaxial, with the axis A of the fluid pathway. The spray head 42 may also have an axis which is substantially parallel, or coaxial, with the axis A of the fluid pathway 46. The fluid pathway 46 may be positioned rearwardly of the spray head 42 and rearwardly of a surface of the cover 17 which surface faces into the chamber 13. A cross-sectional area of the fluid pathway 46 when viewed in a direction substantially orthogonal to the axis A may be greater than a cross-sectional area of the spray head 42. In embodiments the cross-sectional area of the fluid pathway 46 may be the same as, or less than, the cross-sectional area of the spray head 42. In embodiments the cross-sectional area of the fluid pathway 46 is generally circular, or circular. In embodiments the cross-sectional area of the fluid pathway 46 may be oval, elliptical, stadia shaped, rectangular, or other shapes. In embodiments the cross-sectional area of the spray head 42 is generally circular, or circular. In embodiments the cross-sectional area of the spray head 42 may be oval, elliptical, stadia shaped, rectangular, or other shapes.

Figure 8:
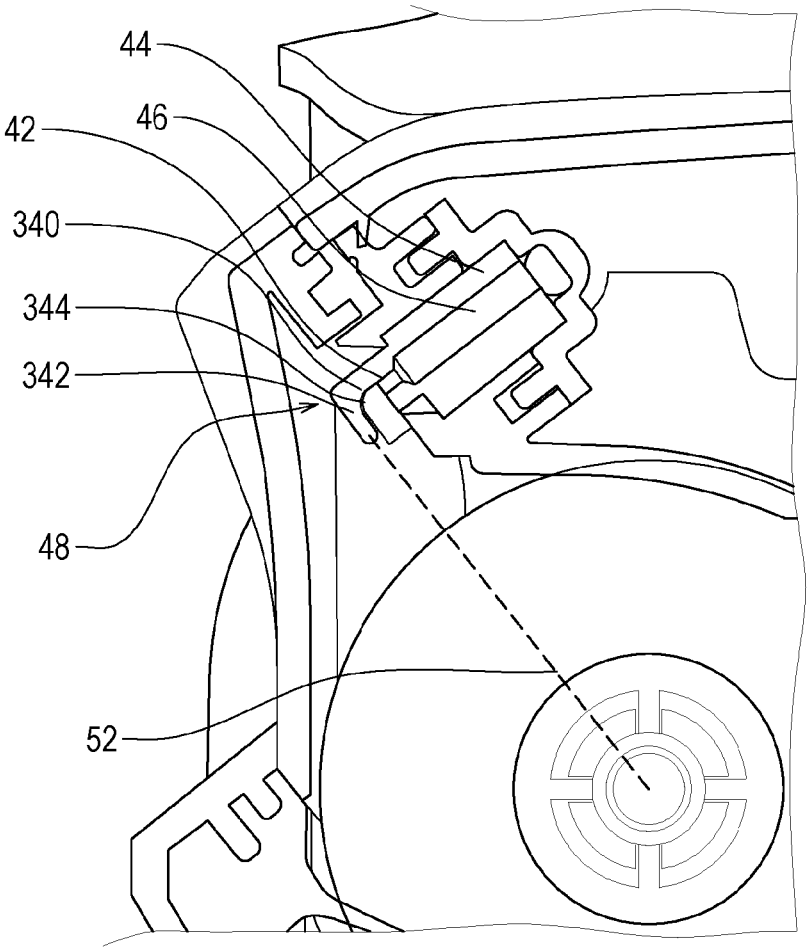
FIGS. 8 and 9 are enlarged views of a portion of FIG. 7.

Referring to FIGS. 7 and 8 the spray nozzle device 40 includes a deflector 48 for deflecting cleaning fluid. The deflector 48 is for deflecting cleaning fluid ejected from the spray head 42. The deflector 48 deflects cleaning fluid towards the axis R of the agitator 11, preferably so as to intersect the axis R of the agitator 11. The deflector 48 may deflect cleaning fluid in a direction substantially orthogonal to the axis A. In other embodiments, it is envisaged that the deflector 48 may deflect cleaning fluid in a direction which is not substantially orthogonal to the axis A. The deflector 48 may be generally arcuate or curved in cross-section when viewed along the axis R of the agitator 11. A first portion 340 of the deflector 48 may be positioned adjacent the spray head 42 to direct cleaning fluid therefrom, and may be positioned in a portion of the chamber 13 which is located rearwardly of a surface of the cover 17 which surface faces into the chamber 13. A second portion 342 of the deflector may lie in a plane which intersects the axis R of the agitator. A third portion 344 may be generally arcuate or curved and connect the first and second portions 340, 342. Collectively the first, second and third portions 340, 342, 344 of the deflector 48 guide fluid in a direction from the spray head 42 along the axis A to along the dotted line 52 which extends between the second portion 342 and the axis R. A cross-sectional area of the deflector 48 may be formed from at least a portion of a circle when viewed in a plane generally perpendicular to the axis A. The cross-sectional area of the deflector 48 may vary along the axis A. In embodiments the deflector 48 may alternatively have a cross-sectional area formed from at least a portion of a rectangle, square, triangle, trapezoid or other polygonal shape without departing from the scope of the present invention.

The deflector 48 is advantageous. The deflector 48 provides an advantageous spray pattern for the cleaning fluid. For example, the deflector 48 may be shaped for spraying cleaning fluid in a frusto-conical pattern to ensure an even wetting of the agitator 11.

The axis A extends, at least partially, over an upwardly facing surface 350 of the agitator 11. The spray nozzle device 40 sprays cleaning fluid towards an upwardly facing surface of the agitator 11. In embodiments the spray nozzle device 40 sprays cleaning fluid to a portion of the agitator 11 between the wiper device 80 and the upper wall 300. The spray nozzle device 40 may only spray cleaning fluid to a sub-portion of this portion, for example to an upper quadrant of the agitator 11 on a side of the plane V closer to the front side 14 of the housing 12.

In embodiments the spray nozzle device 40 and/or the spray head 42 may be releasably connectable to the cleaner head 10. This is advantageous in enabling a cleaning and/or replacement of the spray nozzle 40 and/or spray head 42. This may also be advantageous in enabling different spray patterns to be utilised for different cleaning requirements.

The agitator 11 may have first and second ends 110, 112. The first spray nozzle device 40 may be positioned closer to a first end 110 of the agitator 11. The second spray nozzle device 60 may be positioned closer to a second end 112 of the agitator 11. In particular, the first and/or second spray nozzle devices 40, 60 may be positioned respective distances D3, D4 inwardly of the respective first or second ends 110, 112 of the agitator 11. The distance D3, D4 may be between 20.00 mm and 50.00 mm, or 25.00 mm and 45.00 mm, or 30.00 mm and 40.00 mm, or approximately 34.20 mm, or approximately 27.85 mm.

Figure 9:
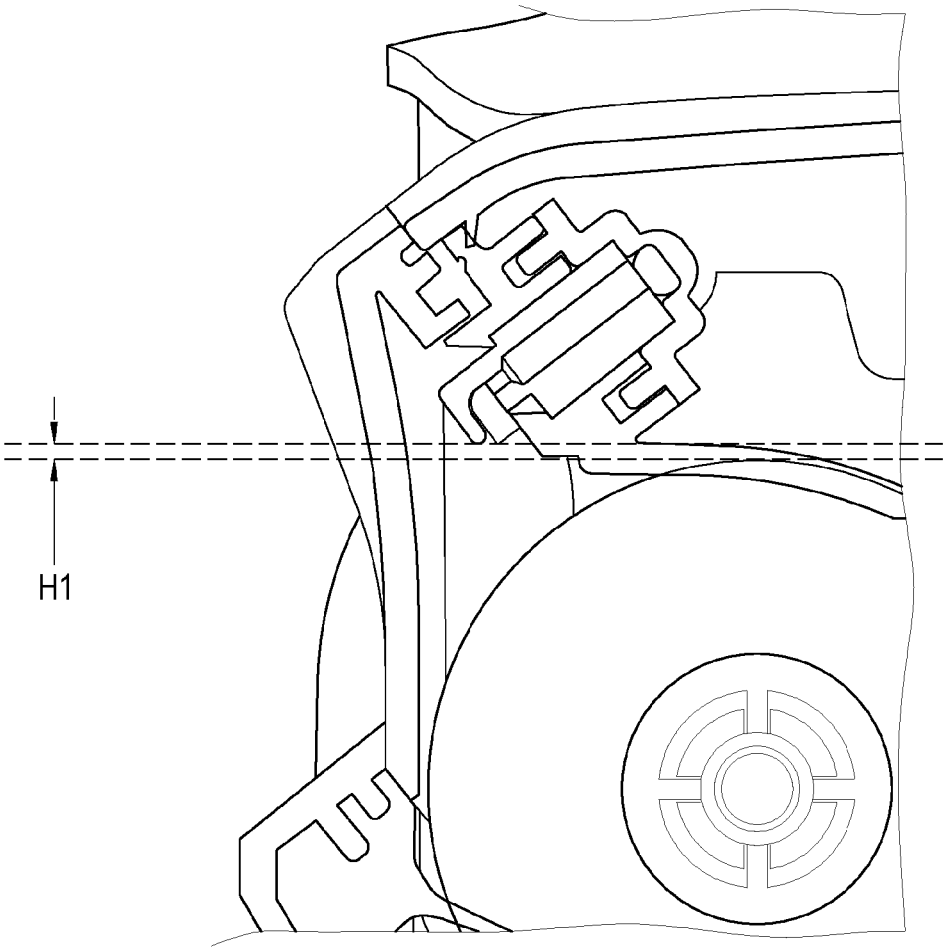

As shown in the figures, the spray nozzle devices 40, 60 are positioned above the upwardly facing surface 350 of the agitator 11, i.e. the spray nozzle devices 40, 60 are positioned above an uppermost portion of the agitator 11. In other words, and with particular reference to FIG. 9, the spray nozzle devices 40, 60 are positioned above a plane which is tangent to the upwardly facing surface 350 of the agitator 11 and which is generally parallel to a surface to be cleaned. In embodiments, it is envisaged that only a portion of the spray nozzle devices 40, 60 may be positioned above the upwardly facing surface 350 of the agitator 11, with the remainder of the spray nozzle devices 40, 60 being positioned below the upwardly facing surface 350 of the agitator 11. In other words, a portion of the spray nozzle devices 40, 60 may be positioned above a plane which is tangent to the upwardly facing surface 350 of the agitator 11 and which is generally parallel to a surface to be cleaned, and a remaining portion of the spray nozzle devices 40, 60 may be positioned below this plane. As shown in FIG. 9, a distance H1 between an end of the spray nozzle devices 40, 60 and a top of the agitator 11 may be between 2.00 mm and 8.50 mm, or 3.00 mm and 7.50 mm, or 4.00 mm and 6.50 mm, or approximately 5.50 mm. The first spray nozzle device 40 may be positioned at a first height and the second spray nozzle device 60 may be positioned at a second height different to the first height.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although certain example embodiments of the invention have been described, the scope of the appended claims is not intended to be limited solely to these embodiments. The claims are to be construed literally, purposively, and/or to encompass equivalents.

The invention claimed is:

1. A cleaner head for a cleaning appliance comprising:

an agitator rotatable about an axis;

a housing having a front side, a rear side, and first and second sides which extend between the front and rear sides, said housing defining a chamber which at least partially surrounds the agitator, the chamber having a dirty air inlet and a dirty air outlet; and a spray nozzle device for spraying cleaning fluid onto the agitator in a direction towards the rear side of the housing, said spray nozzle device configured to be fluidly connectable to a cleaning fluid supply tank of a cleaning apparatus, wherein the spray nozzle device includes a first portion having a fluid pathway extending along an axis A from which cleaning fluid is ejected, said fluid pathway extending towards the front side of the housing and wherein the spray nozzle device includes a deflector for deflecting cleaning fluid ejected from the fluid pathway towards the agitator, and wherein the housing further includes a floor facing surface that includes the dirty air inlet, and wherein the dirty air inlet is between the axis of the agitator and the rear side of the housing.

2. A cleaner head according to claim 1 wherein at least a portion of the spray nozzle device is positioned above an upwardly facing surface of the agitator.

3. A cleaner head according to claim 2 wherein a spray head of the spray nozzle device projects into the chamber.

4. A cleaner head according to claim 3 wherein the spray head is positioned at or near a portion of the chamber which is close to or at the front side of the housing.

5. A cleaner head according to claim 3 wherein the direction in which fluid exits the spray head is in a direction generally orthogonal to the axis of the agitator.

6. A cleaner head according to claim 3 wherein said portion of the spray nozzle device includes the spray head.

7. A cleaner head according to claim 1 wherein at least a portion of the spray nozzle device is positioned above an uppermost portion of the agitator.

8. A cleaner head according to claim 1 wherein at least a portion of the spray nozzle device is positioned above a plane which is tangent to an upwardly facing surface of the agitator and which is generally parallel to a surface to be cleaned.

9. A cleaner head according to claim 1 wherein the deflector deflects cleaning liquid in a direction substantially orthogonal to the axis A.

10. A cleaner head according to claim 1 wherein the deflector deflects cleaning fluid towards the axis of the agitator to intersect the axis of the agitator.

11. A cleaner head according to claim 1 wherein the axis A extends over an upwardly facing surface of the agitator.

12. A cleaner head according to claim 1 wherein said portion of the spray nozzle device includes the fluid pathway and/or the deflector.

13. A cleaner head according to claim 1 wherein the spray nozzle device sprays cleaning fluid downwardly towards an upwardly facing surface of the agitator.

14. A cleaner head according to claim 1 wherein the spray nozzle device is a first spray nozzle device, the cleaner head further including a second spray nozzle device spaced from the first spray nozzle device along a length of the agitator.

15. A cleaner head according to claim 14 wherein the second spray nozzle device is substantially the same as the first spray nozzle device;

wherein the first spray nozzle device is positioned closer to the first side of the housing and the second spray nozzle device is positioned closer to the second side of the housing.

16. A cleaning appliance comprising:

a main body;

a cleaning fluid supply tank for holding a cleaning fluid which is preferably releasably connectable to the main body; and a cleaner head according to claim 1;

wherein the cleaning fluid supply tank is fluidly connected to the spray nozzle device.

17. A cleaning appliance according to claim 16 including a source of suction and a dirt collection container.

18. A cleaner head according to claim 1 wherein the axis about which the agitator rotates is generally parallel to a surface to be cleaned.

19. The cleaner head of claim 1, wherein the dirty air inlet extends between a wiper device configured to contact a surface to be cleaned and a portion of the agitator configured to contact the surface to be cleaned.

20. The cleaner head of claim 1, further comprising a wiper device configured to engage the agitator, wherein the spray nozzle device is positioned between the dirty air inlet and the wiper device in a direction of rotation of the agitator.

21. The cleaner head of claim 1, wherein the dirty air outlet is between the rear side of the housing and the agitator.

22. A cleaner head for a cleaning appliance comprising:

an agitator rotatable about an axis;

a housing having a front side, a rear side, and first and second sides which extend between the front and rear sides, said housing defining a chamber which at least partially surrounds the agitator, the chamber having a dirty air inlet and a dirty air outlet; and a spray nozzle device for spraying cleaning fluid onto the agitator in a direction towards the rear side of the housing, said spray nozzle device configured to be fluidly connectable to a cleaning fluid supply tank of a cleaning apparatus, wherein the spray nozzle device includes a first portion having a fluid pathway extending along an axis A from which cleaning fluid is ejected, said fluid pathway extending towards the front side of the housing and wherein the spray nozzle device includes a deflector for deflecting cleaning fluid ejected from the fluid pathway towards the agitator, wherein the chamber includes an opening for permitting access to and removal of the agitator from the chamber, a cover cooperatively associated with the housing for permitting access to the chamber through the opening, and wherein the cover is moveable to an agitator access position to permit the agitator to be removed from the chamber through the opening.

23. A cleaner head according to claim 22 wherein the cover is pivotably movable with respect to the housing to the agitator access position.

24. A cleaning head according to claim 22 wherein the opening and the cover are positioned at or on the front side of the housing.

25. A cleaning head according to claim 22 wherein the spray nozzle device is positioned on the housing and spaced from the cover.

26. A cleaner head for a cleaning appliance comprising: an agitator rotatable about an axis;

a housing having a front side, a rear side, and first and second sides which extend between the front and rear sides, said housing defining a chamber which at least partially surrounds the agitator, the chamber having a dirty air inlet and a dirty air outlet; and a spray nozzle device for spraying cleaning fluid onto the agitator in a direction towards the rear side of the housing, said spray nozzle device configured to be fluidly connectable to a cleaning fluid supply tank of a cleaning apparatus, wherein the chamber includes an opening for permitting access to and removal of the agitator from the chamber, a cover cooperatively associated with the housing for permitting access to the chamber through the opening, and wherein the cover is moveable to an agitator access position to permit the agitator to be removed from the chamber through the opening, and wherein the cover is pivotably movable with respect to the housing to the agitator access position.

* * * * *